US007313351B2

(12) United States Patent
Toyoda et al.

(10) Patent No.: US 7,313,351 B2
(45) Date of Patent: Dec. 25, 2007

(54) ONE-COMPONENT TYPE DEVELOPING APPARATUS

(75) Inventors: Akinori Toyoda, Katano (JP); Kazumasa Hayashi, Kobe (JP); Akinobu Okuda, Toyonaka (JP); Masao Ootsuka, Sakai (JP); Asao Toda, Kurume (JP); Hideki Yasuda, Toyonaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 185 days.

(21) Appl. No.: 11/195,297

(22) Filed: Aug. 2, 2005

(65) Prior Publication Data

US 2006/0029436 A1 Feb. 9, 2006

(30) Foreign Application Priority Data

Aug. 4, 2004 (JP) ..... 2004-227960

(51) Int. Cl.
*G03G 15/08* (2006.01)

(52) U.S. Cl. ..... 399/279; 399/281; 399/285; 399/286

(58) Field of Classification Search ..... 399/265, 399/279, 281, 286, 285; 430/120; 492/18
See application file for complete search history.

(56) References Cited

U.S. PATENT DOCUMENTS 6,480,692 B2 * 11/2002 Yamazaki et al. ..... 399/281
6,684,047 B2 * 1/2004 Kin et al. ..... 399/284
6,751,423 B2 * 6/2004 Sakaizawa et al. ..... 399/55
7,099,610 B2 * 8/2006 Matsuzaki ..... 399/279

FOREIGN PATENT DOCUMENTS

JP 11-327282 11/1999
JP 2003-13944 1/2003

* cited by examiner

*Primary Examiner*—Hoang Ngo
(74) *Attorney, Agent, or Firm*—Hamre, Schumann, Mueller & Larson, P.C.

(57) ABSTRACT

The present invention provides a one-component development type developing apparatus including a rotatable electrostatic latent image holding member 1 on the surface of which an electrostatic latent image is formed, and using a toner 4 for rendering the electrostatic latent image visible, wherein when the shape factor SF-1 of a toner fine particle is expressed by:

$$SF\text{-}1=(M^2/A)\times(\pi/4)\times 100$$

where A is the projected area of the fine particle and M is the absolute maximum length of the fine particle, then the shape factor SF-1 of the toner 4 is at least 100 and at most 140, and the developing apparatus includes: a toner holding member 3 that is formed from a silicone rubber elastic material and that is for holding the toner 4 and transporting it to the electrostatic latent image holding member 1; a toner layer regulating member 9 for forming the toner on the toner holding member 3 into a thin layer; and a toner supply member 5 that is formed from a silicone rubber foam and that rotates, in a position opposed to the toner holding member 3, in a direction opposite to that of the toner holding member 3, and an AC electric field is formed between the toner holding member 3 and the toner supply member 5.

9 Claims, 5 Drawing Sheets

ONE-COMPONENT TYPE DEVELOPING APPARATUS

BACKGROUND OF THE INVENTION

1. Field of the Invention

The present invention relates to developing apparatuses for electrophotographic image forming apparatuses used in copiers, printers, facsimiles, and machines that combine these functions. In particular, the present invention relates to one-component type developing apparatuses in which a spherical toner is formed into a layer on a toner holding member and, in a development region, the spherical toner is developed onto an electrostatic latent image holding member.

2. Description of Related Art

In recent years, electrophotographic developing apparatuses can be classified roughly into one-component development systems in which only a toner is used and two-component development systems in which a toner and a carrier are used. In the one-component development systems, a toner is supplied from a toner supply member to a toner transporting (holding) member, and after the toner is formed into a thin layer by a layer regulating member, the toner is developed onto an electrostatic latent image on a photoreceptor, which is an electrostatic latent image holding member.

On the other hand, in the two-component development systems, a magnetic brush is formed, using a developer constituted by a toner and a carrier that is constituted by magnetic particles, on a magnet roller containing a magnet, and then the toner is developed while the magnetic brush is rubbed against the electrostatic latent image on the photoreceptor, which is the electrostatic latent image holding member.

In the one-component development systems, a toner replenishment mechanism is simpler than that in the two-component development systems, and a mechanism for mixing and stirring the toner and the carrier and a toner concentration sensor for detecting the mixing ratio of the toner are not necessary. Thus, the one-component development system is suitable for miniaturization of the apparatuses. On the other hand, since the one-component development systems do not use a carrier as a charging member, the toner cannot be charged uniformly, and thus there are problems such as fogging due to adhesion of the toner to non-image portions, a reduction in the image density in solid image portions, and the occurrence of uneven image density.

Furthermore, there is a problem of the occurrence of white stripes and black stripes in that the toner transporting member formed from an elastic member and the toner supply member formed from a foam member partially wear away, and thus portions of lighter and darker density appear on an image corresponding to the wear portions.

As the toner transporting member, a development roller made by forming silicone rubber or urethane rubber, which is an elastic member, on a metal shaft often is used. From the viewpoint of imparting chargeability to the toner, silicone rubber material is often used.

Moreover, as the toner supply member, a toner supply roller made by foaming urethane resin on a metal shaft is used, and a method of forming projections and depressions on the surface of the roller, by controlling the foaming conditions, and transporting the toner to the development roller often is used. However, since urethane resin has a low ability to charge the toner, when a toner having a low amount of charge is developed, there is the problem of fogging in which the toner adheres to non-image portions and the problem of an increase in the image density due to the low amount of charge.

As a measure for improving that toner-charging ability, a developing apparatus in which a foamed silicone rubber is used as the supply roller is proposed in JP H11-327282A. With this configuration, the problems of fogging and an increase in the image density can be avoided because of the chargeability of silicone rubber.

Moreover, an example of preventing clogging in a supply roller made of a foamed silicone rubber or urethane rubber is proposed in JP 2003-13944A. According to this configuration, clogging of the toner in the cells of the foam is prevented by making the shape of the toner spherical.

However, when using the supply roller formed from a silicone rubber foam as in the configuration in JP H11-327282A, although the toner-charging ability is improved, wear of the supply roller is exacerbated promoted more than when using a urethane rubber foam.

In particular, in the case of a toner having an irregular shape, polishing action by the toner is increased, and thus wear of the supply roller is increased. Consequently, the ability to transport the toner to the development roller is decreased, and thus problems of uneven image density and poor image-density reproduction due to variations in the thickness of the toner layer occur. Moreover, the contact pressure between the supply roller and the development roller is reduced, and thus problems of fogging due to a reduction in the amount of charge and an increase in the image density also occur.

Moreover, there is the problem of black stripes in that the hardness of the supply roller is increased because cell portions of the foam material are filled up with the toner, and wear of the development roller is promoted, resulting in an increase in the image density in the area of that wear.

That is to say, when using the supply roller formed from a silicone rubber foam, wear of the supply roller and the development roller is promoted, and thus there is a problem in that the life is reduced.

Moreover, when using a silicone sponge made of a foam material and a toner that is made spherical as in JP 2003-13944A, the polishing action of the toner is reduced due to the shape effect, and thus wear of the supply roller and the development roller can be prevented. Moreover, clogging of the toner in the supply roller hardly occurs, and thus hardening of the supply roller due to the toner can be prevented.

However, since the toner that is made spherical has fewer points at which it is brought into contact with the development roller and the supply roller than the toner having an irregular shape, the number of times the toner is charged is decreased. The chargeability is reduced and thus the phenomenon of fogging occurs.

Moreover, with this toner, the transporting ability deteriorates because the image force to the development roller is decreased due to a reduction in the chargeability and the intermolecular force with respect to the development roller is decreased due to the spherical shape, so that a problem of solid-image reproducibility occurs.

SUMMARY OF THE INVENTION

The present invention is directed to solve the conventional problems as described above, and it is an object of the present invention to provide a one-component development type developing apparatus that can realize both extension of the life and promotion of charging of the toner.

In order to achieve the above-described object, the developing apparatus of the present invention is a one-component development type developing apparatus including a rotatable electrostatic latent image holding member on the surface of which an electrostatic latent image is formed, and using a toner for rendering the electrostatic latent image visible, wherein when the shape factor SF-1 of a toner fine particle is expressed by $SF\text{-}1=(M^2/A)\times(\pi/4)\times100$, where A is the projected area of the fine particle and M is the absolute maximum length of the fine particle, then the shape factor SF-1 of the toner is at least 100 and at most 140, wherein the developing apparatus comprises: a toner holding member that is formed from a silicone rubber elastic material and that is for holding the toner and transporting it to the electrostatic latent image holding member; a toner layer regulating member for forming the toner on the toner holding member into a thin layer; and a toner supply member that is formed from a silicone rubber foam and that rotates, in a position opposed to the toner holding member, in a direction opposite to that of the toner holding member, and wherein an AC electric field is formed between the toner holding member and the toner supply member.

DETAILED DESCRIPTION OF THE INVENTION

Figure 1:
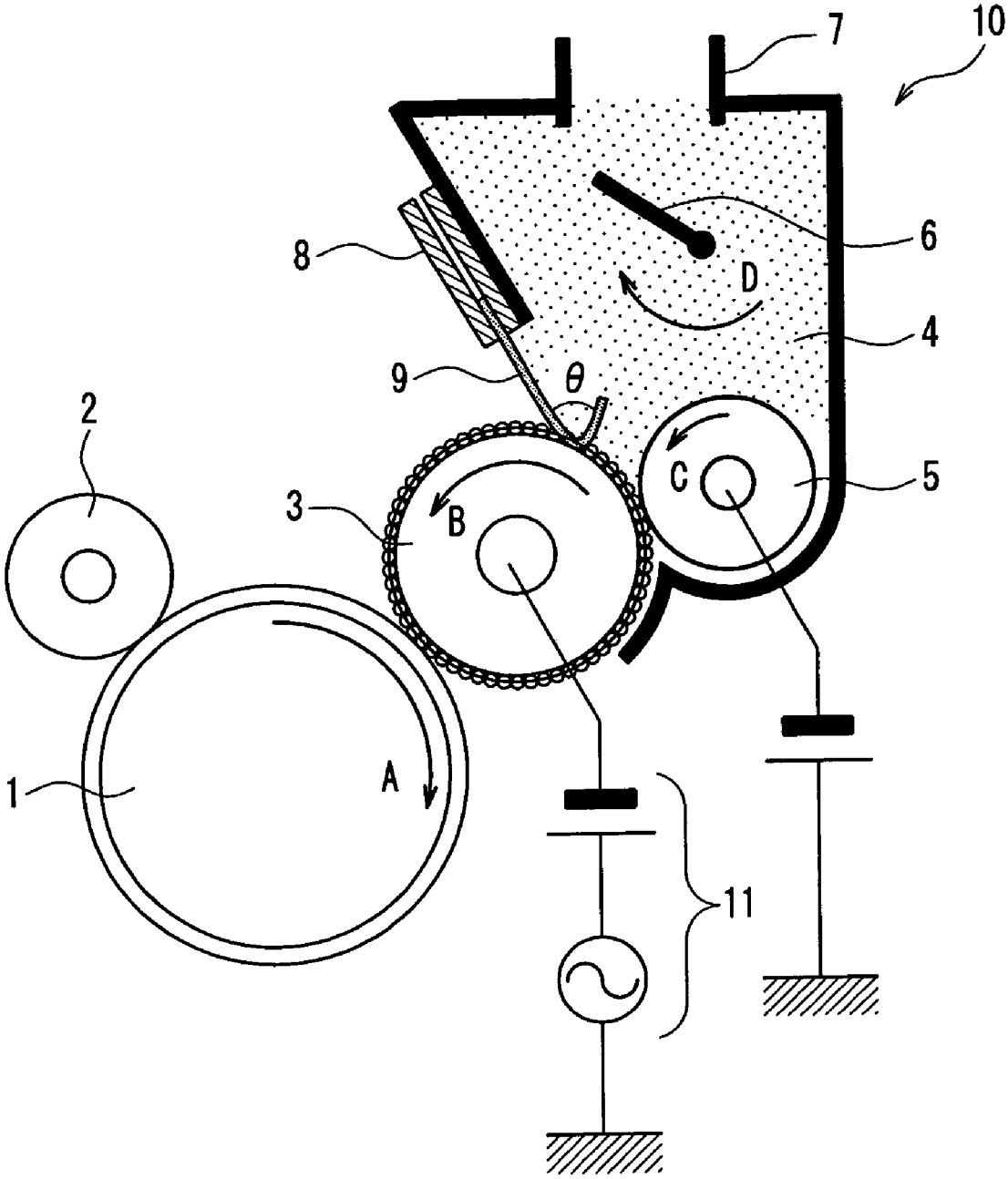
FIG. 1 is a cross-sectional view of a developing apparatus according to Embodiment 1 of the present invention.

In the developing apparatus of the present invention, by using a spherical toner, it is possible to prevent wear of the development roller (toner holding member) and the supply roller (toner supply member), which are elastic members. Thus the life of the apparatus can be extended.

Furthermore, it is possible to prevent the supply roller from being filled up with the toner by virtue of the properties of the spherical toner. Thus wear of the development roller due to hardening of the supply roller can be prevented.

Moreover, by virtue of the properties of the spherical toner, the chargeability is reduced, and transport failures due to slippage are assumed to occur on the development roller. However, in the developing apparatus of the present invention, the AC electric field is formed between the two members, the development roller formed from silicone rubber and the supply roller formed from a silicone rubber foam, both having a high ability to impart a charge to the toner. Thus, disturbance and back-and-forth motion of the toner can be promoted, and the amount of charge is increased, so that a solid-image reproducibility due to prevention of fogging and ensuring of the transporting ability can be improved.

In the above-described developing apparatus of the present invention, it is preferable that the amplitude of an AC voltage applied to form the AC electric field is set to at least 100 V and at most 1200 V. With this configuration, disturbance and back-and-forth motion between the toner holding member and the toner supply member are increased, and the toner-charging ability is improved.

Moreover, it is preferable that the frequency of the AC voltage applied to form the AC electric field is set to at least 1 kHz and at most 5 kHz. With this configuration, disturbance and back-and-forth motion between the toner holding member and the toner supply member are increased, and the toner-charging ability is improved.

Moreover, it is preferable that the surface roughness Rz of the toner holding member is within a range of 3 μm to 20 μm. With this configuration, the number of times the toner holding member comes into contact with the toner is increased, and the charging ability is improved. Moreover, random disturbance and back-and-forth motion are produced when the AC is applied, so that charging is accelerated. Thus, fogging can be prevented and the toner-transporting ability also can be ensured.

Moreover, it is preferable that the average spacing S between local crests on the surface of the toner holding member is within a range of 50 μm to 150 μm. With this configuration, disturbance and back-and-force motion at the time when the AC is applied are promoted, and the toner-charging ability can be improved. If the average spacing S is large, then the disturbing action is reduced, and if the average spacing S is small, then back-and-force motion hardly occurs and the effect of improving the amount of charge cannot be obtained.

Moreover, it is preferable that the toner layer regulating member has a portion in which a resin material is formed on a metal support, and in an area where the portion in which the resin material is formed and the toner holding member come into contact with each other, the toner is formed into a thin layer and an AC electric field is applied between the toner layer regulating member and the toner holding member. With this configuration, charging can be promoted due to back-and-force motion between the portion in which the resin material is formed and the toner holding member (development roller), so that a high amount of charge can be achieved even when the spherical toner is used. When the toner layer regulating member is constituted only by the metal blade, leakage, for example, occurs, and thus it is difficult to use it.

Moreover, it is preferable that the toner contains, as a lubricant, at least one or more metallic soaps of zinc stearate, calcium stearate, aluminum stearate, and magnesium stearate. With this configuration, by providing lubricity to the toner by the action of the metallic soap, wear of the development roller and the supply roller can be limited to a low level.

Moreover, it is preferable that hydrophobic silica subjected to a surface treatment with silicone oil is used as an external additive in the toner. With this configuration, the coefficients of friction between the three members, i.e., the development roller, the supply roller, and the toner, each having the material properties of silicone are reduced, and consequently, wear of the development roller and the supply roller can be prevented.

Moreover, it is preferable that the developing apparatus further includes a toner scraping member that abuts against the surface of the toner supply member. With this configuration, since the toner scraping member is provided, the toner can be refreshed by scraping off the charged toner on the toner supply member, and thus aggregation of the toner around the toner supply member can be inhibited. Thus, it is possible to inhibit the progress of wear of the toner holding member (development roller) due to toner aggregation on the toner supply member.

Before describing the present invention specifically, the circumstances leading to the present invention will be described. Conventionally, a developing apparatus using a development roller made of silicone rubber, a supply roller made of a urethane foam, and a pulverized toner to which a wax is internally added often has been used.

In this developing apparatus, the ability of the development roller to impart a charge to the toner might be reduced due to adhesion of the wax component in the toner to the development roller. Thus, in order to prevent the reduction in the charge-imparting ability, it has been attempted to maintain the ability to impart a charge to the toner by using a urethane foam sponge roller having a high hardness as the supply roller, and refreshing the surface of the development roller by polishing the development roller with this urethane foam sponge roller.

Therefore, in the conventional developing apparatus, the use of a silicone foam having a low hardness as the supply roller has been hard to consider in terms of its ability to polish the development roller.

On the other hand, when using a supply roller having a high hardness, although the ability to polish the development roller is increased, linear scratches are made on the development roller due to wear, and thus black stripes on non-image portions or white stripes on solid image portions occur, and thus it has been difficult to extend the life of the developing apparatus.

Here, as described above, JP H11-327282A proposes the use of a foamed silicone rubber as the supply roller. With this configuration, the hardness of the supply roller is low, so that this configuration is effective in preventing the occurrence of the linear scratches on the development roller due to wear. However, wear of the supply roller is promoted. In addition, due to the low hardness, the ability to polish the development roller is reduced as described above.

The inventors have been studied on this point, and finally found that if a toner containing a wax and manufactured by employing, for example, emulsion aggregation is used as the toner, it becomes difficult for the wax component in the toner to adhere to the development roller, and as a result, the need for polishing the development roller is eliminated, and thus a supply roller having a low hardness could be used.

However, when emulsion aggregation is used, the ability of the toner itself to be charged is low, so that it was feared that the problems of fogging in non-image portions and an increase in the image density are newly caused by the low ability to be charged.

The inventors have conducted extensive researches on this problem, and finally invented a developing apparatus in which, in order to impart a charge to the toner, a silicone foam sponge rubber having a high charge-imparting ability is used as the supply roller and a silicone rubber having a high charge-imparting ability is used as the development roller, and furthermore, in order to promote the chargeability of the toner, an AC electric field is formed between the development roller and the supply roller.

With this developing apparatus, since the toner moves back and forth between the development roller (silicone rubber roller) and the supply roller (silicone sponge roller) both having a high ability to impart a charge to the toner, charging of the toner is promoted, and the amount of that charge is maintained without decaying.

Therefore, according to the present invention, by preventing wear of the development roller with the supply roller having a low hardness and with the toner that was manufactured using emulsion aggregation, and by forming an AC electric field between the development roller and the supply roller, it is possible to promote charging of the toner. That is to say, according to the present invention, both extension of the life of the developing apparatus and promotion of charging of the toner can be realized.

Hereinafter, developing apparatuses according to embodiments of the present invention will be described with reference to the drawings.

Embodiment 1

Embodiment 1 will be described with reference to Working Example 1. As an apparatus for image evaluation serving as Working Example 1, KX-CL500 (manufactured by Panasonic) whose developing apparatus part was modified was used. This machine operates at a processing speed of 100 mm/s and is capable of printing 16 sheets of A4 paper per minute. Various numerical values, materials, and so on that are given below as an example belong to this working example.

FIG. 1 is a cross-sectional view showing the principal part of a developing apparatus 10 according to Embodiment 1 of the present invention. The developing apparatus 10 is a one-component development type developing apparatus that uses a toner for rendering an electrostatic latent image visible.

A photosensitive drum 1, which is an electrostatic latent image holding member, is a layered organic photoreceptor. It has an outer diameter of 24 mm, and is made to rotate in a direction shown by the arrow A at a circumferential speed of 100 mm/s by an external drive (not shown).

A charging roller 2, which is a charging member, was made by forming epichlorhydrin rubber having a thickness of 3 mm on a metal shaft having an outer diameter of 6 mm, and was set to an outer diameter of 12 mm. The charging roller 2 was pressed against the photosensitive drum 1 with a force of 3 N applied on one side thereof, and driven by the rotation of the photosensitive drum 1.

The charging roller 2 was charged using an AC charging method. Regarding the applied charging voltage, the DC component was −600 V, and the AC component was a sine wave having a frequency of 1 kHz and an amplitude of 1.5 kVp-p (peak-to-peak). The potential of the charge on the photosensitive drum 1 was measured with a surface potential measuring instrument MODEL 344 (manufactured by Treck), and found to be −600 V.

In order to produce an electrostatic latent image on the charged photosensitive drum 1, a laser scanner unit (not shown) having a resolution of 600 DPI (dot/inch) was used as an exposure device. An electrostatic latent image of a desired image was formed with Working Example 1. A latent image of a solid image was formed, and the potential on that area was measured and found to be −50 V.

Next, a toner 4 used in the developing apparatus 10 will be described. The toner 4 that was used experimentally was a magenta toner. First, toner matrix particles having a composition of 80 wt % of styrene butyl acrylate resin, 8 wt % of a quinacridone pigment that is a magenta coloring agent, 10 wt % of carnauba wax serving as a parting agent, and 2 wt % of a charge control agent made of aluminum salicylate were obtained. The average particle size was 5.5 μm, and the SF-1 value representing the shape factor (sphericity) was 120.

The SF-1 value was calculated with Formula (1) below, where A is the projected area of a fine particle and M is the absolute maximum length of the fine particle:

$$SF\text{-}1=(M^2/A)\times(\pi/4)\times 100 \qquad \text{Formula (1)}$$

As shown in Formula (1), the SF-1 value is obtained by multiplying the ratio of the area of a circle having a diameter M to the projected area A of a fine particle by 100. Thus, as the SF-1 value decreases (approaches 100), the shape of the fine particle becomes closer to spherical.

For the calculation of the SF-1 value, a Real Surface View Microscope VE 7800 series manufactured by KEYENCE CORPORATION was used, and 1000 toner images enlarged at a magnification of 1000 were sampled at random and the images were analyzed.

Then, 98.5 wt % of the above-described toner matrix particles having a shape factor of 120, and as external additives, 1.0 wt % of silica particles having an average particle size of 40 nm that were treated with hexamethyldisilazane so as to have hydrophobicity, and 0.5 wt % of silica particles having an average particle size of 12 nm that were treated with dimethyldichlorosilane so as to have hydrophobicity, were a total of 2 kg were mixed by stirring at 1200 revolutions per minute using a Henschel mixer FM 20-B (manufactured by Mitsui Miike Kakoki), and used as magenta toner particles.

This toner was replenished into the developing apparatus 10 from a toner replenishing transport path (not shown) via a toner replenishing port 7. The developing apparatus 10 is capable of accommodating about 40 g of the toner 4. In the developing apparatus 10, a toner stirring member 6 is provided. The toner stirring member 6 is formed from a PET sheet having a length of 8 mm and a thickness of 0.2 mm. The toner stirring member 6 rotates in the direction shown by the arrow D at a velocity of 0.5 revolutions/second, and the replenished toner 4 in the developing apparatus 10 is stirred and then transported to a supply roller 5, which is a toner supply member.

The supply roller 5 was made by forming a silicone rubber foam into a roller shape on a metal shaft having an outer diameter of 6 mm, and was set to an outer diameter of 13.2 mm. The supply roller 5 rotates in the direction shown by the arrow C at a circumferential speed of 60 mm/s.

When the characteristics of the roller were measured according to the JIS-k-6400 standard, the density was 0.13 g/cm$^3$, the number of cells was 75 (cells/25 mm), and the gas permeability was 0.75 cm$^3$/(cm$^2$·sec).

Moreover, the resistance was measured according to JIS-k-6911, and found to be $1\times10^5$ Ω. The surface hardness was 39 (Aska F).

A development roller 3 is an elastic toner holding member for holding the toner 4 and transporting it to the photosensitive drum 1. A silicone rubber having a thickness of 4 mm was bonded to a metal shaft having a diameter of 8 mm, so that the roller had an outer diameter of 16.0 mm.

Moreover, the surface roughness Rz was set to 2.0 μm by surface polishing, and the average spacing between local crests was set to 40 μm. The value of resistance was measured according to JIS-k-6911, and found to be $2\times10^5$ Ω. In a finished development roller 3, a rubber surface hardness was 45 degrees (JIS-A).

The development roller 3 was rotated in the direction shown by the arrow B at a circumferential speed of 133 mm/s. Thus, the development roller 3 rotates, at the position opposed to the supply roller 5, in a direction opposite to that of the supply roller 5.

Moreover, the development roller 3 is pressed against the electrostatic latent image holding member 1 with a force having a total pressure of 13 N.

A sine wave constituted by a DC component of −250 V and an AC component having a frequency of 1000 Hz and an amplitude of 400 Vp-p (peak-to-peak) was applied to the development roller 3 by a developing bias power source 11.

The distance between the axis of the development roller 3 and that of the supply roller 5 was 14 mm, and the amount that the supply roller 5 cuts into the development roller 3 was 0.6 mm. A voltage of −250 V was applied to the supply roller 5 as the DC component, so that the DC components applied to the two rollers were at the same potential. As described above, by applying the AC component to the development roller 3 by the developing bias power source 11, an AC electric field was formed between the two rollers.

A pair of supports 8 having a thickness of 2 mm supports an 8 mm portion of a metal blade 9, which is a toner layer regulating member. The metal blade 9 is for forming the toner on the development roller 3 into a thin layer and was formed from a metal plate having a thickness of 0.1 mm and a length of 20 mm. A 2 mm portion at the front end of the metal blade 9 was bent as shown in FIG. 1 so that the bending angle θ was 60° C. Thus, the free length of the metal blade 9 was set to 10 mm.

The metal blade 9 cut into the development roller 3 by an amount of 0.75 mm, and the angle between the tangential direction of the development roller 3 and the blade plate was set to 30° C. The metal blade 9 and the development roller 3 were at the same potential. In this working example, a uniform toner layer having a thickness of 0.41 mg/cm$^2$ was formed on the development roller 3. The amount of charge on the toner was −18.5 μC/g.

The electrostatic latent image on the above-described photosensitive drum 1 (electrostatic latent image holding member) was brought into contact with the development roller 3 having the toner layer on its surface and developed to form a toner image on the photosensitive drum 1, and thus the electrostatic latent image on the photosensitive drum 1 was rendered visible.

The toner image formed on the photosensitive drum 1 was transferred onto an intermediate transfer belt formed from a polycarbonate film. This transfer was performed by applying a voltage of +600 V to a primary transfer roller located on the back of the intermediate transfer belt. Next, the toner on the intermediate transfer belt was transferred onto paper by a secondary transfer roller, on the back of the paper, to which a bias of +1000 V was applied. Finally, the paper was passed through a fixing device to produce a color image by a belt whose surface was heated. Any toner remaining on the photosensitive drum 1 and the intermediate transfer belt was collected into a waste toner box by a cleaning blade formed from urethane rubber.

The principal configuration of the present embodiment (Working Example 1) described above can be summarized as follows. In the present embodiment, the supply roller 5 is formed from a silicone rubber foam having a high charge-imparting ability, the development roller 5 is formed from silicone rubber having a high charge-imparting ability, an AC electric field is formed between the two rollers, and the SF-1 value of the toner is set to 120, which is close to that of a spherical shape.

Moreover, in order to confirm the effects of Working Example 1, various comparative examples were fabricated. The comparative examples were fabricated by replacing a part of the principal configuration of Working Example 1 with other configurations.

In Comparative Example 1, the silicone rubber for the development roller 3 of the developing apparatus 10 was replaced by urethane rubber. The development roller of Comparative Example 1 was made by bonding a urethane rubber having a thickness of 4 mm and a rubber hardness of 45 degrees (JIS-A) to a metal shaft having a diameter of 8 mm, and was set to an outer diameter of 16.0 mm. The surface roughness Rz of the development roller of Comparative Example 1 was set to 2.0 μm by surface polishing, and the average spacing S between local crests was set to 40 μm. Moreover, the value of resistance was measured according to JIS-k-6911, and found to be $2\times10^5$ Ω.

In Comparative Example 2, the silicone rubber foam for the supply roller 5 of the developing apparatus 10 was replaced by a urethane rubber foam. The supply roller of Comparative Example 2 was made by forming the urethane rubber foam on a metal shaft having an outer diameter of 6 mm, and was set to an outer diameter of 13.2 mm. The density of the supply roller of Comparative Example 2 was 0.13 g/cm$^3$, the number of cells was 76 (cells/25 mm), and the gas permeability was 0.74 cm$^3$/(cm$^2$·sec). The surface hardness was 40 (Aska F) in Aska F hardness.

In Comparative Example 3, the toner was different from that of Working Example 1. In Comparative Example 3, pulverized toner matrix particles having a composition of 80 wt % of styrene acrylic resin, 8 wt % of a quinacridone pigment that is a magenta coloring agent, 10 wt % of carnauba wax serving as a parting agent, and 2 wt % of a charge control agent made of aluminum salicylate were obtained by using melt kneading and pulverization. The average particle size was 5.7 μm, and the sphericity (SF-1 value) was 150.

Then, 98.5 wt % of the toner matrix particles, 1.0 wt % of silica particles having an average particle size of 40 nm that were treated with hexamethyldisilazane so as to have hydrophobicity, and 0.5 wt % of silica particles having an average particle size of 12 nm that were treated with dimethyldichlorosilane so as to have hydrophobicity were mixed by stirring using a Henschel mixer FM 20-B (manufactured by Mitsui Miike Kakoki), and used as magenta toner particles.

An evaluation was performed with respect to Working Example 1 and Comparative Examples 1 to 3 as described above. Details of the evaluation are as described below.

The particle size distribution of the toner was measured using a Coulter Counter (manufactured by Coulter Counter).

The amount of charge on the toner on the development roller was measured in the following manner. Ajig that rotates alone, separately from the developing apparatus, was produced, the toner was vacuumed and collected onto a filter to measure its electric charge with an electrometer, 6517A (manufactured by KEITHLEY), and its weight was measured before and after the suction. Based on the electric charge and the weights, the amount of charge Q/m (μC/g) was calculated.

Regarding the thickness of the toner layer, the amount of the toner that adhered to a 3 cm$^2$ area on the development roller was measured using an adhesive tape. The amount of the adhering toner per unit area was taken as the layer thickness (mg/cm$^2$).

Moreover, regarding the surface roughness Rz of the development roller and the average spacing S between local crests, a measurement was performed, according to JIS-B0601:'94, along the axial direction using a SURFCOM130A (manufactured by TOKYO SEIMITSU CO., LTD.). The surface roughness was measured at five points, namely at the center of the development roller and at positions located away from the center by distances 50 mm and 100 mm to the right and left, and the average value was calculated.

Moreover, a test was conducted, using a print image sample having a blackening rate of 5%, by performing an intermittent printing operation in which a one-minute cycle of printing on three consecutive sheets of paper and then stopping was performed repeatedly. Printing was performed up to the 30,000th sheet, and then a comparative evaluation with the initial characteristics was conducted.

Regarding the image density, a total of 16 points on the image were extracted, and a measurement was performed at these points with a reflection densitometer, RD914 (manufactured by Macbeth). The average value was taken as the image density, and the 3σ value was taken as unevenness of the image density. For each color, the target for the image density was set to 1.4±0.1, and the target for unevenness of the density was set to within 0.15.

Fogging that occurs when the toner adheres to a non-image portion was evaluated using a Photovolt MODEL 577 (manufactured by Photovolt Instruments Inc., U.S.A.). The target for fogging was that a reduction in the reflectivity on paper after printing relative to that on paper before printing was 1.0% or less.

Moreover, black stripes and white stripes were evaluated with an image analysis device, NEXIV (manufactured by Nikon Corporation), using a halftone image having a blackening rate of 25%. The criteria were as follows: cases where an increase in the density in black stripe portions and a reduction in the density in white stripe portions were 0.03 or less were regarded as "good", and cases where they were more than 0.03 were regarded as "poor".

The printing test was performed up to the 30,000th sheet using the above-described four different types of examples, Working Example 1 and Comparative Examples 1 to 3. Table 1 below shows the results.

TABLE 1

| | | Amount of charge (μC/g) | Layer thickness (mg/cm$^2$) | Image density (ID) | Unevenness of image density (3σ) | Fogging Δ % | White stripes/Black stripes |
|---|---|---|---|---|---|---|---|
| Working Ex. 1 | Beginning | −18.5 | 0.41 | 1.41 | 0.052 | 0.5 | good |
| | After 30,000 sheets | −15.5 | 0.37 | 1.36 | 0.079 | 0.9 | good |
| Com. Ex. 1 | Beginning | −11.5 | 0.29 | 1.23 | 0.063 | 1.5 | good |
| | After 30,000 sheets | −8.5 | 0.24 | 1.12 | 0.175 | 2.6 | good |

TABLE 1-continued

| | | Amount of charge (μC/g) | Layer thickness (mg/cm$^2$) | Image density (ID) | Unevenness of image density (3σ) | Fogging Δ % | White stripes/Black stripes |
|---|---|---|---|---|---|---|---|
| Com. Ex. 2 | Beginning | −12.6 | 0.31 | 1.22 | 0.054 | 1.5 | good |
| | After 30,000 sheets | −7.2 | 0.27 | 1.08 | 0.123 | 1.8 | good |
| Com. Ex. 3 | Beginning | −20.6 | 0.43 | 1.44 | 0.042 | 0.4 | good |
| | After 30,000 sheets | −11.2 | 0.28 | 1.19 | 0.192 | 2.3 | poor |

As shown in Table 1, in Working Example 1, all of the image density, unevenness of the image density, fogging, and white stripes and black stripes were at a problem-free level, indicating good results.

On the other hand, in Comparative Examples 1 and 2, both of the amount of charge and the layer thickness were low from the beginning, the image density was low, and also fogging increased. It is believed that the reason for this is that since, in Comparative Examples 1 and 2, either one of the supply roller or the development roller was made of a urethane material, the toner-charging ability was reduced.

In Comparative Example 3, although the amount of charge was high and good images were obtained at the beginning, after printing of 30,000 sheets, the amount of charge was low, and a reduction in the density and uneven image density occurred. Moreover, the problem of white stripes and black stripes occurred.

Moreover, the outer diameter of the development roller was measured at the beginning and after printing of 30,000 sheets, and it was found that after printing of 30,000 sheets, the outer diameter was reduced by 0.010 mm as compared to that at the beginning in Working Example 1, whereas the outer diameter was reduced by 0.331 mm in Comparative Example 3. Observing the supply roller of Comparative Example 3, it was found that clogging of the toner in the foam member occurred, and the toner hardened, shaving the development roller.

Based on these facts, it is believed that, in Comparative Example 3, by using the toner having an irregular shape (SF-1 value:150), the progress of wear was promoted due to clogging of the toner into the foam member, and as the operation continued, the charge-imparting ability also was reduced due to this clogging.

Furthermore, in Working Example 1, research was conducted to examine the effects of the AC electric field. The amount of charge was measured by changing the amplitude of the AC voltage applied to the development roller 3 to 0 (DC voltage only), 100, 200, 400, 800, 1200, and 1600 V. The amount of charge was −10.5, −16.8, −17.6, −18.4, −18.9, −19.5, and −10.3 μC/g, respectively. These measurement results are shown in FIG. 2.

Moreover, the amount of charge was also measured by changing the frequency to 0 (DC voltage only), 0.3, 0.5, 1, 3, 5, and 7 kHz. The amount of charge was −10.5, −16.5, −17.6, −18.4, −18.5, −18.6, and −16.2 μC/g, respectively. These measurement results are shown in FIG. 3.

Figure 2:
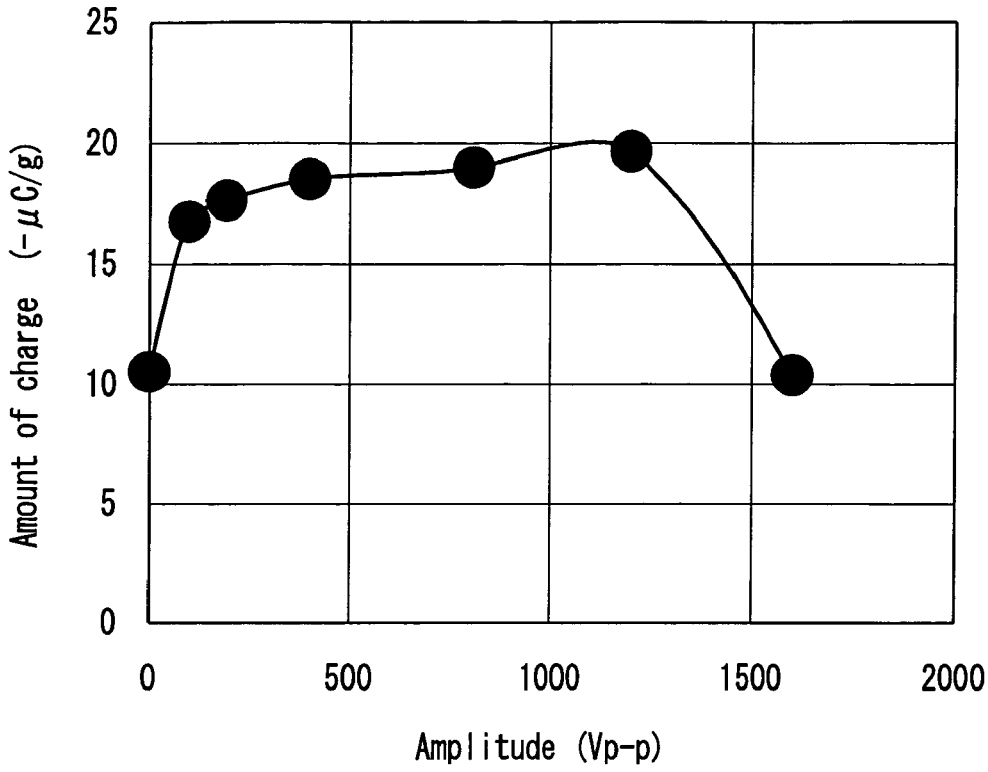
FIG. 2 is a graph showing a relationship between the AC amplitude and the amount of charge according to Embodiment 1 of the present invention.
Figure 3:
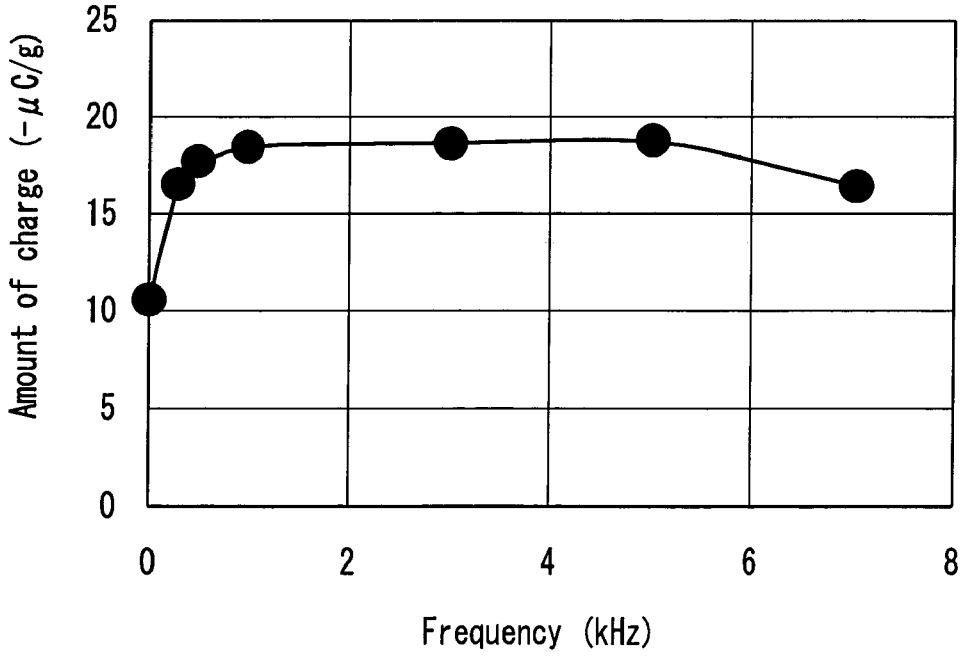
FIG. 3 is a graph showing a relationship between the frequency and the amount of charge according to Embodiment 1 of the present invention.

From FIGS. 2 and 3, it is found that by applying an AC voltage, the toner-charging ability was improved when compared to the cases where only a DC component was applied. It is believed that this is because disturbance and back-and-forth motion were generated, and furthermore charge injection was performed, between the development roller 3 and the supply roller 5. It was found from FIG. 2 that as the amplitude is increased, the toner-charging ability is improved, but at 1.6 kV, leakage occurred, and the effect of improving the amount of charge could not be achieved. Thus, it was found that the amplitude value is preferably at least 100 V and at most 1200 V.

Referring to FIG. 3, the maximum amount of charge was obtained at frequencies of 1 to 5 kHz, but at a frequency of 7 kHz, the amount of charge was reduced. It is believed that this is because when the frequency was too high, it became difficult for the toner to follow it, and thus disturbance and back-and-forth motion of the toner in the AC electric field was reduced.

Next, in order to examine the charging characteristics of the toner depending on its shape, toners having shape factors (SF-1 values) of 102, 110, 130, and 140 were produced by employing the same composition as that of the toner 4 and by changing the emulsion polymerization conditions. An evaluation of the chargeability was performed on these toners as well as the toner 4 having a shape factor of 120 of Working Example 1 and the pulverized toner having a shape factor of 150 of Comparative Example 3.

The amount of charge was measured under different conditions, namely that an AC voltage having a frequency of 1 kHz and an amplitude of 400 Vp-p was applied between the development roller 3 and the supply roller 5 and that no AC voltage was applied. Under the condition that an AC voltage having a frequency of 1 kHz and an amplitude of 400 Vp-p was applied, the amount of charge was −17.5, −18.1, −18.4, −19.3, −20.1, and −20.6 μC/g in order of increasing shape factors. Moreover, under the condition that no AC voltage was applied, the amount of charge was −8.8, −11.3, −13.9, −15.9, −17.7, and 19.2 μC/g in order of increasing shape factors.

Figure 4:
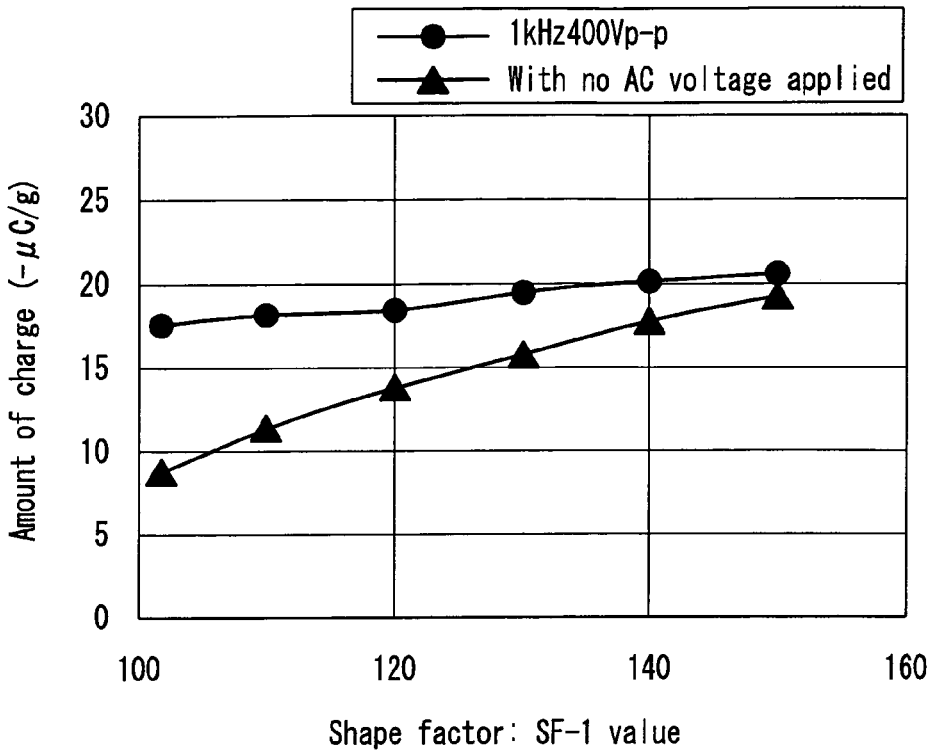
FIG. 4 is a graph showing a relationship between the shape factor, SF-1 value, and the amount of charge according to Embodiment 1 of the present invention.

These results are shown in FIG. 4. It is found that although the amount of charge is increased by application of an AC voltage, regardless of the value of the SF-1 value, width of the increasing amount of charge on a toner whose shape is closer to spherical, that is to say, a toner whose shape has a SF-1 value closer to 100, is increased by a larger amount of charge by application of an AC voltage. From these results, it seems that the toner moves back and forth due to the AC electric field, so that the amount of charge on the toner is increased, and it was found that the smaller the SF-1 value, the greater this effect.

Moreover, printing was performed up to the 30,000th sheet with the toners having SF-1 values of 102, 110, 130, and 140, and good images were obtained while neither the problems of fogging and a reduction in the density nor the problem of clogging in the supply roller occurred. Moreover, the fact that good images were obtained in Working Example 1 in which the SF-1 value was 120 already has been confirmed as described above. From the foregoing results, it was found that the shape factor, SF-1 value, is preferably at least 100 and at most 140.

It should be noted that although the layered-type organic photoreceptor having negative charge polarity was used in the present embodiment, it is also possible to use a single-layer organic photoreceptor, in which a charge transport layer and a charge generation layer are formed into one layer, or a photoreceptor having a configuration in which an a-Si material is used, and also the polarity of the charge on the photoreceptor may be either negative or positive.

Moreover, although a system in which an AC bias is applied to the charging roller 2 made of epichlorhydrin rubber was used, a DC charging roller system also may be used. For the charging roller 2, urethane rubber, silicone rubber, NBR rubber, acrylic rubber, fluorine rubber, and the like can be used, and it is also possible to perform treatments such as surface coating, if necessary. Moreover, a scorotron system using a wire and a grid or a system using a solid state charging device also may be used.

Moreover, it is preferable that the supply roller 5 rotates at such a speed that the circumferential speed ratio of the supply roller 5 to the development roller 3 is 0.5 to 3.0. If the circumferential speed ratio is low, then the maximum image density is reduced, and if the circumferential speed ratio is high, then the drive is burdened and torque fluctuations are caused, resulting in the occurrence of a jittery image due to speed variations.

Moreover, it is desirable that the rubber hardness of the development roller 3 is 10 to 80 degrees (JIS-A Standard) from the viewpoint of performing one-component development. If the rubber hardness is low, then permanent set of the roller occurs easily, and if it is high, then wear of the supply roller 5 is promoted and thus the life of the developing apparatus is reduced.

It is desirable that the development roller 3 rotates at such a speed that the circumferential speed ratio of the development roller 3 to the photosensitive drum 1 is 0.8 to 3.0. A low circumferential speed ratio will cause lack of image density, and a high circumferential speed ratio will cause torque fluctuations.

Moreover, although the potential difference in the DC component between the supply roller 5 and the development roller 3 were set to the same value in Working Example 1, for example the potential difference may be 100 V, and can be set as needed within a range of about −300 V to +300 V.

Although a sine wave was used as the AC voltage applied to the development roller 3 in Working Example 1, it is also possible to use a rectangular wave, a triangle wave, and the like. Moreover, when using a rectangular wave or the like, the ratio between the positive and negative polarities, application of blank pulses, and the like can be chosen as appropriate.

In Working Example 1, in a fully exposed area of a solid image portion, a potential difference of 200 V was produced between the development roller 3 and the photosensitive drum 1. The present invention is not limited to this, and it is desirable to set the development potential to 50 to 500 V while adjusting the image density and the like, if necessary.

Moreover, although an example in which styrene acrylic resin was used as a binder resin was described, it is also possible to use polyester resin, epoxy resin, or a combination of these resins.

Moreover, examples of the pigment that can be used include pigments containing one or more types of the following pigments and dyes: black pigments such as carbon black, iron black, graphite, nigrosine, and a metal complex of an azo dye; arylamide acetoacetate monoazo yellow pigments such as C.I. pigment yellow 1, 3, 74, 97, and 98; arylamide acetoacetate diazo yellow pigments such as C.I. pigment yellow 12, 13, 14, and 17; C.I. solvent yellow 19, 77, and 79; C.I. disperse yellow 164; red pigments such as C.I. pigment red 48, 49:1, 53:1, 57, 57:1, 81, 122, and 5; red dyes such as C.I. solvent red 49, 52, 58, and 8; and blue dyes or pigments such as phthalocyanine or a derivative thereof, such as C.I. pigment blue 15:3. The amount of the pigment to be added is preferably from 3 to 15 parts by weight per 100 parts by weight of binder resin.

Moreover, in order to charge the toner, one or more types of charge control agents may be added, if necessary. About 1 to 7 wt % of material can be added according to whether the toner is to be charged negatively or positively.

Moreover, in order to improve charging of the toner or the fluidity of the toner, microparticles having an average particle size of 5 to 200 nm, such as silica, alumina, and titania, are added. The microparticles can be subjected to a surface treatment so as to have hydrophobicity, if necessary.

Moreover, it is desirable that the average particle size of the toner is 3 to 12 μm. If the particle size is too large, then it is difficult to achieve a high resolution. If the particle size is too small, then the fluidity of the toner is poor and stable layer formation cannot be performed, and thus uneven image density occurs.

Moreover, although emulsion polymerization was used in order to adjust the SF-1 value to 100 to 140; it is also possible to render the toner spherical by, for example, suspension polymerization or a method of performing a heat treatment after pulverization, if necessary.

Embodiment 2

In Embodiment 2, the conditions to which the surface of the development roller 3 was polished were changed. The surface roughness was Rz=2 μm in Working Example 1 described above, whereas the surface roughness was set to 3 μm in working Example 2, 5 μm in Working Example 3, 10 μm in Working Example 4, 15 μm in Working Example 5, 20 μm in Working Example 6, and 25 μm in Working Example 7. The average spacing S between local crests was set to 40 μm in all of these working examples. Regarding Working Examples 2 to 7, the same evaluation as that shown in Table 1 above was conducted. Table 2 below shows the evaluation results.

TABLE 2

| | Surface Roughnes Rz(μm) | | Amount of charge (μC/g) | Layer thickness (mg/cm$^2$) | Image density (ID) | Unevenness of image density (3σ) | Fogging Δ % | White stripes/Black stripes |
|---|---|---|---|---|---|---|---|---|
| Working Ex. 1 | 2 | Beginning | −18.5 | 0.41 | 1.41 | 0.052 | 0.5 | Good |
| | | After 30,000 sheets | −15.5 | 0.37 | 1.36 | 0.079 | 0.9 | Good |

TABLE 2-continued

| | Surface Roughnes Rz(μm) | | Amount of charge (μC/g) | Layer thickness (mg/cm$^2$) | Image density (ID) | Unevenness of image density (3σ) | Fogging Δ % | White stripes/Black stripes |
|---|---|---|---|---|---|---|---|---|
| Working Ex. 2 | 3 | Beginning | −20.5 | 0.43 | 1.44 | 0.045 | 0.3 | Good |
| | | After 30,000 sheets | −18.2 | 0.42 | 1.47 | 0.055 | 0.6 | Good |
| Working Ex. 3 | 5 | Beginning | −20.8 | 0.41 | 1.43 | 0.042 | 0.3 | Good |
| | | After 30,000 sheets | −18.8 | 0.39 | 1.43 | 0.051 | 0.5 | Good |
| Working Ex. 4 | 10 | Beginning | −21.7 | 0.4 | 1.42 | 0.043 | 0.2 | Good |
| | | After 30,000 sheets | −19.8 | 0.41 | 1.41 | 0.046 | 0.5 | Good |
| Working Ex. 5 | 15 | Beginning | −22.6 | 0.42 | 1.41 | 0.039 | 0.2 | Good |
| | | After 30,000 sheets | −20.8 | 0.43 | 1.4 | 0.042 | 0.4 | Good |
| Working Ex. 6 | 20 | Beginning | −23.8 | 0.41 | 1.45 | 0.036 | 0.2 | Good |
| | | After 30,000 sheets | −21.5 | 0.42 | 1.45 | 0.035 | 0.3 | Good |
| Working Ex. 7 | 25 | Beginning | −24.9 | 0.42 | 1.46 | 0.105 | 0.2 | Good |
| | | After 30,000 sheets | −22.6 | 0.41 | 1.44 | 0.125 | 0.2 | Good |

In all of Working Examples 2 to 6, the amount of charge is improved more, fogging decreases more, and unevenness of the density is improved more than in Working Example 1.

In Working Example 7, the amount of charge is improved more, fogging decreases more than in Working Example 1. In Working Example 7, the unevenness of the density is larger than in Working Example 1, however this value is within target value 0.15.

Figure 5:
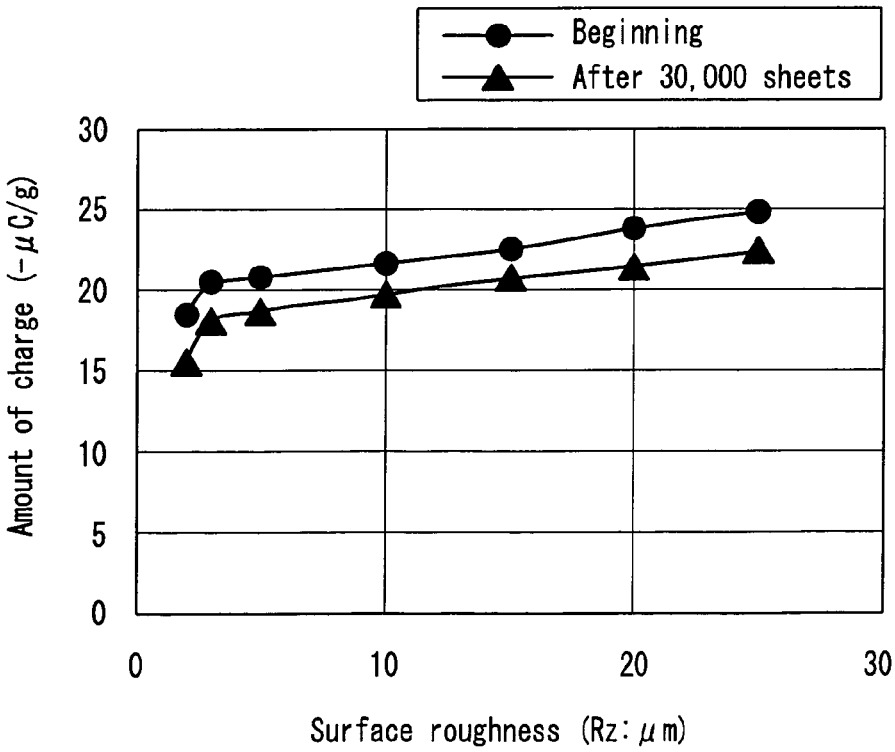
FIG. 5 is a graph showing a relationship between the surface roughness Rz of a development roller and the amount of charge according to Embodiment 2 of the present invention.

Moreover, the relationship between the surface roughness and the amount of charge (at the beginning and after printing of 30,000 sheets) in Working Examples 1 to 7 is shown in FIG. 5.

When Rz was 3 μm or more, the effect of improving the charging ability was achieved at the beginning and also after printing of 30,000 sheets. From the foregoing results, it is found that when the surface roughness Rz is increased and projections and depressions are increased, the number of times the development roller 3 and the toner 4 come into contact with each other is increased, and the charging ability is improved. Moreover, it also is found that random back-and-forth motion occurs when the AC current is applied, and charging is accelerated.

However, it also was found that when Rz becomes 25 μm or more, the thickness of the toner layer is reduced in the projection portions, and a problem of white spots occurs. Thus, from the viewpoint of improving the amount of charge and increasing the image quality, it is preferable that the surface roughness Rz of the development roller 3 is within a range of 3 μm to 20 μm.

It should be noted that although in the above-described working examples the polishing conditions were changed in order to change the surface roughness, it is possible to use a sandblasting treatment, a glass bead blasting treatment, and the like, if necessary. Furthermore, the surface roughness may be changed by adding inorganic microparticles such as silica particles, titanium oxide particles, or red iron oxide or organic resin microparticles such as silicone microparticles or acrylic microparticles.

Embodiment 3

In Embodiment 3, Working Example 8 in which the surface roughness of the development roller Rz=5.0 μm and the average spacing S between local crests was 70 μm was produced. Table 3 below shows the evaluation results at the beginning and after 30,000 sheets.

TABLE 3

| | Average Spacing S(μm) | | Amount of charge (μC/g) | Layer thickness (mg/cm$^2$) | Image density (ID) | Unevenness of image density (3σ) | Fogging Δ % | White stripes/Black stripes |
|---|---|---|---|---|---|---|---|---|
| Working Ex. 3 | 40 | Beginning | −20.8 | 0.41 | 1.43 | 0.042 | 0.3 | Good |
| | | After 30,000 sheets | −18.8 | 0.39 | 1.43 | 0.051 | 0.5 | Good |

TABLE 3-continued

| | Average Spacing S(μm) | | Amount of charge (μC/g) | Layer thickness (mg/cm$^2$) | Image density (ID) | Unevenness of image density (3σ) | Fogging Δ % | White stripes/Black stripes |
|---|---|---|---|---|---|---|---|---|
| Working Ex. 8 | 70 | Beginning | −24.1 | 0.42 | 1.43 | 0.035 | 0.2 | Good |
| | | After 30,000 sheets | −23.6 | 0.43 | 1.42 | 0.032 | 0.2 | Good |

From the results in Table 3, it is found that in Working Example 8, the amount of charge is improved more, fogging decreases more, and also unevenness of the density is improved more than in Working Examples 3 in which the average spacing S between local crests was 40 μm.

Furthermore, development rollers in which the average spacing S between local crests was set to 50, 70, 100, 120, 150, and 180 μm were produced while the surface roughness Rz was fixed to 5.0 μm, and the amount of charge at the beginning was measured. The amount of charge was −20.8, −23.1, −24.1, −24.5, −24.1, −23.5, and 19.8 μC/g in order of increasing average spacings, these values including the data of Working Example 3 in which the average spacing S was 40 μm.

Figure 6:
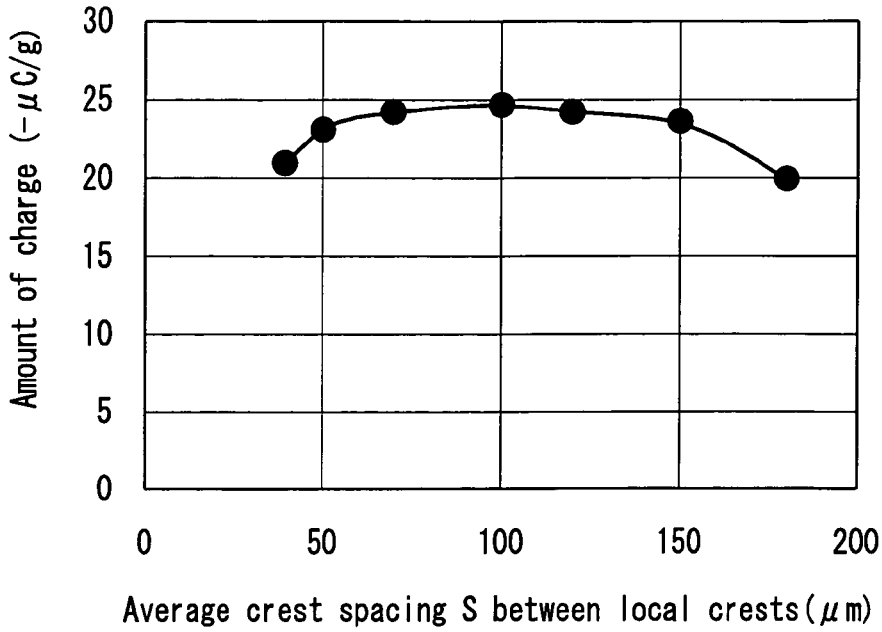
FIG. 6 is a graph showing a relationship between the average crest spacing S between local crests on the surface of the development roller and the amount of charge according to Embodiment 3 of the present invention.

These results are shown in FIG. 6. It is found that the amount of charge is increased when the average spacing is within a range of 50 μm to 150 μm. It is believed that this is because, within such a particular range, disturbance of the toner in the AC electric field progressed even more, and the amount of charge on the toner was increased.

Embodiment 4

In Embodiment 4, in the metal blade 9, which is the toner layer regulating member of the developing apparatus 10 shown in FIG. 1, a resin layer was formed in the portion of the metal blade 9 that comes into contact with the development roller 3, and an AC electric field is applied between the metal blade 9 and the development roller 3.

In Working Example 9, the resin layer was made of imide resin having a thickness of 12 μm. Furthermore, in Working Example 9, the potential of the metal blade was not set to be the same as that of the development roller 3, and only the DC component of −250 V of the voltage applied to the development roller 3 was applied to the metal blade 9. Since the DC component of −250 V and the AC component having a frequency of 1000 Hz and an amplitude of 400 Vp-p were applied to the development roller 3, an AC electric field was formed between the metal blade 9 and the development roller 3.

Table 4 below shows the results of Working Example 9.

TABLE 4

| | | Amount of charge (μC/g) | Layer thickness (mg/cm$^2$) | Image density (ID) | Unevenness of image density (3σ) | Fogging Δ % | White stripes/Black stripes |
|---|---|---|---|---|---|---|---|
| Working Ex. 1 | Beginning | −18.5 | 0.41 | 1.41 | 0.052 | 0.5 | good |
| | After 30,000 sheets | −15.5 | 0.37 | 1.36 | 0.079 | 0.9 | good |
| Working Ex. 9 | Beginning | −21.2 | 0.4 | 1.42 | 0.035 | 0.2 | good |
| | After 30,000 sheets | −20.2 | 0.39 | 1.41 | 0.041 | 0.3 | good |

As can be seen from the results in Table 4, in Working Example 9, the result that the amount of charge was increased and fogging was low at the beginning and also after printing of 30,000 sheets was obtained. It is believed that this is because a charge could be imparted to the toner in the metal blade 9 portion and thus a high amount of charge was achieved.

Furthermore, using the toners having the SF-1 values (102, 110, 120, 130, 140, and 150) that were used in the experiment in FIG. 4, an evaluation of toner-charging ability was conducted in the cases where an AC electric field was formed using the present developing apparatus and where the development roller 3 and the metal blade 9 were at the same potential as in Embodiment 1.

In the case where the development roller 3 and the metal blade 9 were at the same potential, the amount of charge was −15.5, −16.1, −16.4, −17.3, −18.1, and −18.6 μC/g in order of increasing SF-1 values.

On the other hand, in the case where the AC electric field was formed, the amount of charge was −20.8, −20.8, −20.9, −21.2, −22.3, and −23.1 μC/g in order of increasing SF-1 values.

Figure 7:
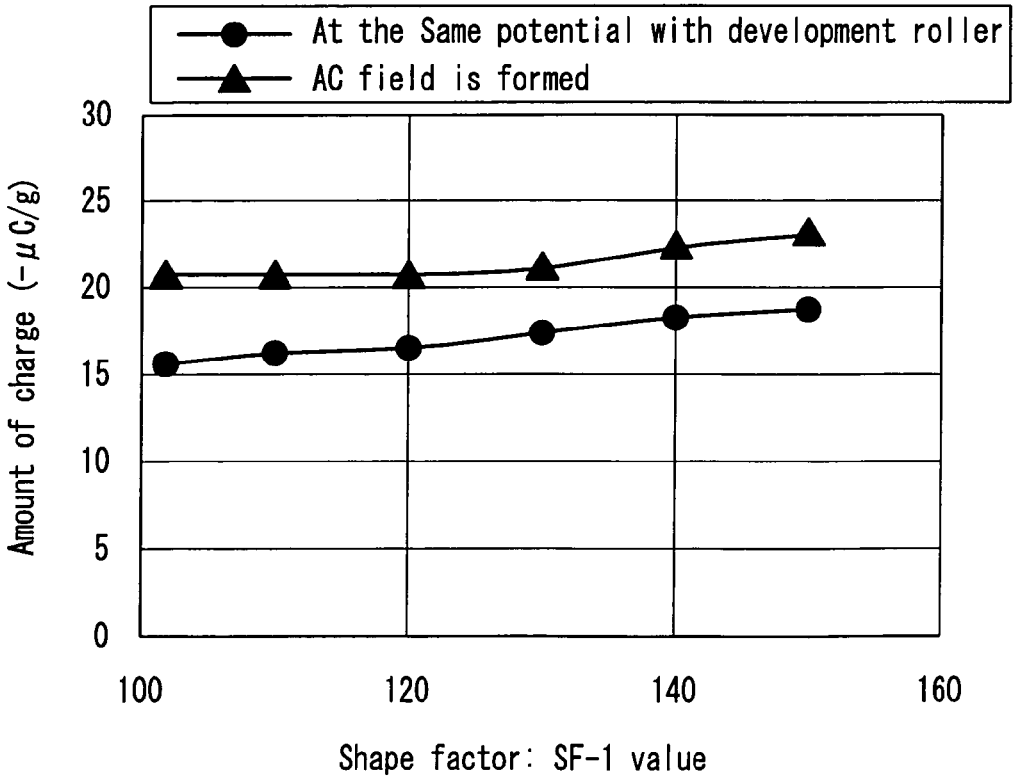
FIG. 7 is a graph showing a relationship between whether or not an AC is applied to a layer regulating portion and the amount of charge according to Embodiment 4 of the present invention.

The results of this comparative evaluation are shown in FIG. 7. From these results, it was found that a high amount of charge can be obtained when an AC electric field is formed between a resin blade, which is the portion of the metal blade 9 that comes into contact with the development roller 3, and the development roller 3. It is believed that this is because disturbance and back-and-forth motion of the toner 4 were promoted even in the layer regulating portion.

It should be noted that although the example in which the blade coated with imide resin was used was described, it is also possible to use silicone resin, acrylic resin, and the like.

Embodiment 5

In Embodiment 5, a metallic soap serving as a lubricant was added as an external additive to the toner 4 in Embodiment 1. In Working example 10, a toner in which 1.0 wt % of zinc stearate having an average particle size of 1.5 μm was used. Table 5 below shows the evaluation results.

TABLE 5

| | | Amount of charge (μC/g) | Layer thickness (mg/cm$^2$) | Image density (ID) | Unevenness of image density (3σ) | Fogging Δ % | White stripes/Black stripes |
|---|---|---|---|---|---|---|---|
| Working Ex. 1 | Beginning | −18.5 | 0.41 | 1.41 | 0.052 | 0.5 | good |
| | After 30,000 sheets | −15.5 | 0.37 | 1.36 | 0.079 | 0.9 | good |
| Working Ex. 10 | Beginning | −18.7 | 0.41 | 1.41 | 0.052 | 0.5 | good |
| | After 30,000 sheets | −18.9 | 0.4 | 1.4 | 0.051 | 0.6 | good |

In Working Example 10, the result that the amount of charge was high and also fogging was low even after printing of 30,000 sheets was obtained. The amount of wear of the development roller after printing of 30,000 sheets was measured, and it turned out to be 0.004 mm, i.e., almost no wear. This can be attributed to the fact that wear of the development roller 3 and the supply roller 5 could be reduced by using the lubricant.

Moreover, although an example in which zinc stearate was used was described, it is believed that the same effect can be achieved as long as the toner contains, as a lubricant, at least one or more metallic soaps of zinc stearate, calcium stearate, aluminum stearate, and magnesium stearate.

Embodiment 6

The toner 4 in Embodiment 1 (Working Example 1) was produced by adding, as external additives, 1.0 wt % of silica particles having an average particle size of 40 nm that were treated with hexamethyldisilazane so as to have hydrophobicity and 0.5 wt % of silica particles having an average particle size of 12 nm that were treated with dimethyldichlorosilane so as to have hydrophobicity.

In Embodiment 6, hydrophobic silica subjected to a surface treatment with silicone oil is used as an external additive in the toner. In Working Example 11, instead of these external additives in Working Example 1, external additives obtained by treating both of the 40-nm silica and the 12-nm silica with silicone oil so as to have hydrophobicity were used. Table 6 below shows the evaluation results.

TABLE 6

| | | Amount of charge (μC/g) | Layer thickness (mg/cm$^2$) | Image density (ID) | Unevenness of image density (3σ) | Fogging Δ % | White stripes/Black stripes |
|---|---|---|---|---|---|---|---|
| Working Ex. 1 | Beginning | −18.5 | 0.41 | 1.41 | 0.052 | 0.5 | good |
| | After 30,000 sheets | −15.5 | 0.37 | 1.36 | 0.079 | 0.9 | good |
| Working Ex. 11 | Beginning | −20.5 | 0.42 | 1.45 | 0.038 | 0.2 | good |
| | After 30,000 sheets | −20.4 | 0.42 | 1.45 | 0.035 | 0.2 | good |

As can be seen from the results in Table 6, in Working Example 10 the result that the amount of charge was high and fogging was low at the beginning and also after printing of 30,000 sheets was obtained. The amount of wear of the development roller after printing of 30,000 sheets was measured, and it turned out to be 0.005 mm, i.e., almost no wear. This can be attributed to the fact that wear of the development roller 3 and the supply roller 5 could be reduced by using the silicas that were rendered hydrophobic with silicone oil as the external additives.

Embodiment 7

Figure 8:
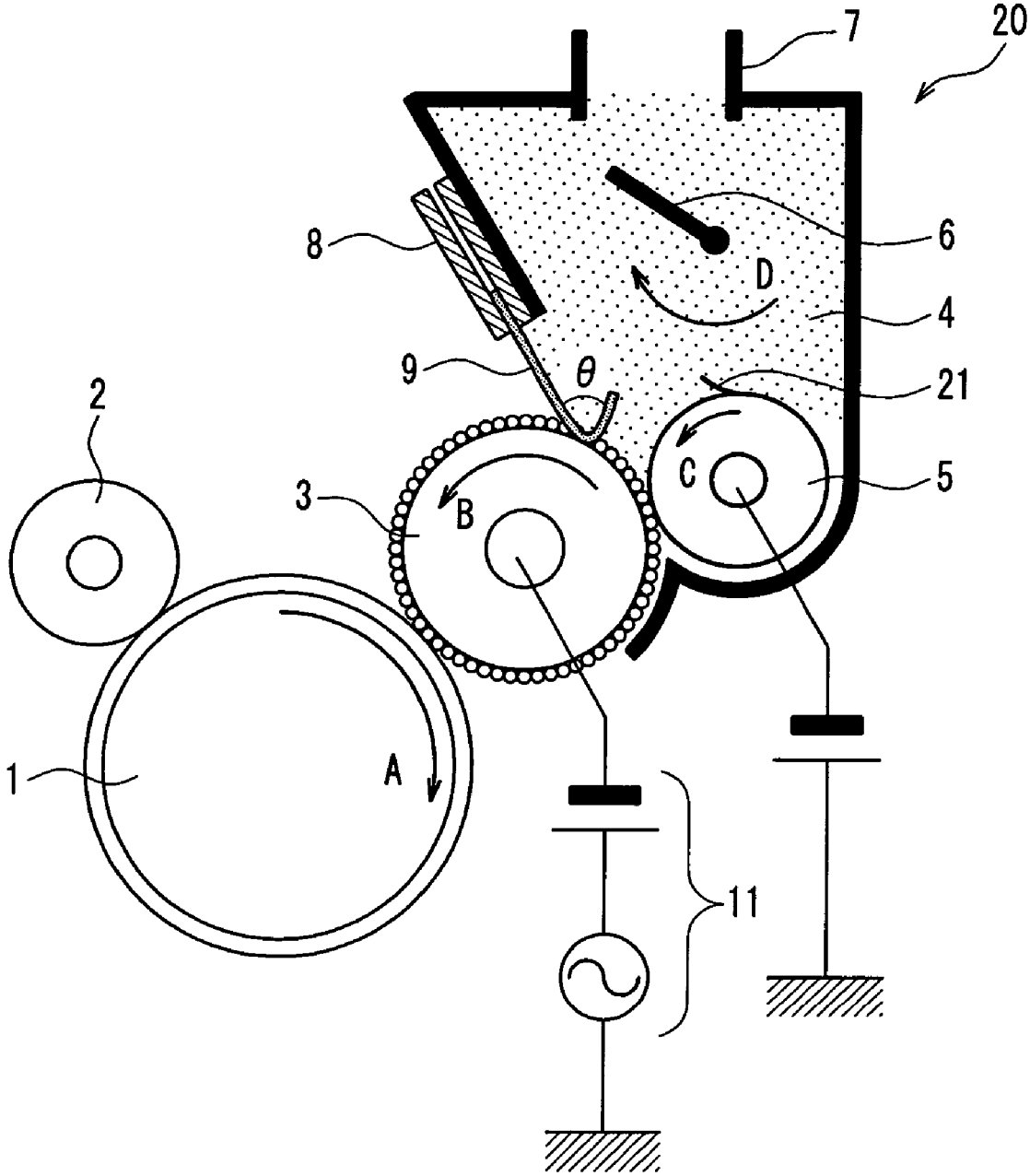
FIG. 8 is a cross-sectional view of a developing apparatus according to Embodiment 7 of the present invention.

FIG. 8 is a cross-sectional view showing the principal part of a developing apparatus 20 according to Embodiment 7. Structural elements that are the same as those in FIG. 1 bear the same numerals, and descriptions thereof will be omitted. In the configuration in FIG. 8, a scraping member 21 is caused to abut against the supply roller 5.

In Working Example 12, the scraping member 21 having a length of 4 mm and a thickness of 2 mm was added to the developing apparatus in Embodiment 1, and an evaluation was conducted. Table 7 below shows the evaluation results.

TABLE 7

| | | Amount of charge (μC/g) | Layer thickness (mg/cm$^2$) | Image density (ID) | Unevenness of image density (3σ) | Fogging Δ % | White stripes/Black stripes |
|---|---|---|---|---|---|---|---|
| Working Ex. 1 | Beginning | −18.5 | 0.41 | 1.41 | 0.052 | 0.5 | good |
| | After 30,000 sheets | −15.5 | 0.37 | 1.36 | 0.079 | 0.9 | good |
| Working Ex. 12 | Beginning | −18.2 | 0.41 | 1.46 | 0.035 | 0.4 | good |
| | After 30,000 sheets | −18.3 | 0.43 | 1.44 | 0.032 | 0.4 | good |

As can be seen from the results in Table 7, in Working Example 12 the amount of charge was not reduced even after printing of 30,000 sheets, and good results were also obtained with respect to fogging and unevenness of the image density.

The present invention can realize both extension of the life and promotion of charging of the toner, and thus are useful as copiers, fax machines, printers, MFPs (multifunctional printers), and the like. Moreover, the present invention also can be applied to such purposes as producing patterns of printed boards.

The invention may be embodied in other forms without departing from the spirit or essential characteristics thereof The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A one-component development type developing apparatus comprising a rotatable electrostatic latent image holding member on the surface of which an electrostatic latent image is formed, and using a toner for rendering the electrostatic latent image visible, wherein when the shape factor SF-1 of a toner fine particle is expressed by:

$$SF\text{-}1=(M^2/A)\times(\pi/4)\times 100$$

where A is the projected area of the fine particle and M is the absolute maximum length of the fine particle, then the shape factor SF-1 of the toner is at least 100 and at most 140, wherein the developing apparatus comprises:

a toner holding member that is formed from a silicone rubber elastic material and that is for holding the toner and transporting it to the electrostatic latent image holding member;

a toner layer regulating member for forming the toner on the toner holding member into a thin layer; and a toner supply member that is formed from a silicone rubber foam and that rotates, in a position opposed to the toner holding member, in a direction opposite to that of the toner holding member, and wherein an AC electric field is formed between the toner holding member and the toner supply member.

2. The developing apparatus according to claim 1, wherein the amplitude of an AC voltage applied to form the AC electric field is set to at least 100 V and at most 1200 V.

3. The developing apparatus according to claim 1, wherein the frequency of an AC voltage applied to form the AC electric field is set to at least 1 kHz and at most 5 kHz.

4. The developing apparatus according to claim 1, wherein the surface roughness Rz of the toner holding member is in a range of 3 μm to 20 μm.

5. The developing apparatus according to claim 4, wherein the average spacing S between local crests on the surface of the toner holding member is in a range of 50 μm to 150 μm.

6. The developing apparatus according to claim 1, wherein the toner layer regulating member has a portion in which a resin material is formed on a metal support, and wherein, in an area where the portion in which the resin material is formed and the toner holding member come into contact with each other, the toner is formed into a thin layer and an AC electric field is applied between the toner layer regulating member and the toner holding member.

7. The developing apparatus according to claim 1, wherein the toner contains, as a lubricant, at least one or more metallic soaps of zinc stearate, calcium stearate, aluminum stearate, and magnesium stearate.

8. The developing apparatus according to claim 1, wherein hydrophobic silica subjected to a surface treatment with silicone oil is used as an external additive in the toner.

9. The developing apparatus according to claim 1, further comprising a toner scraping member that abuts against the surface of the toner supply member.

* * * * *